US006382638B1

(12) United States Patent
Lee

(10) Patent No.: US 6,382,638 B1
(45) Date of Patent: May 7, 2002

(54) SKATE ATTACHABLE TO AN ATHLETIC SHOE

(76) Inventor: Tzu-Yang Lee, P.O. Box 90, Tainan City (TW)

( * ) Notice: Subject to any disclaimer, the term of this patent is extended or adjusted under 35 U.S.C. 154(b) by 0 days.

(21) Appl. No.: 09/688,113

(22) Filed: Oct. 16, 2000

(51) Int. Cl.[7] ..... A63C 17/18

(52) U.S. Cl. ..... 280/7.13; 280/11.231; 280/11.3; 36/115

(58) Field of Search ..... 280/7.1, 7.12, 280/7.13, 7.14, 11.19, 11.221, 11.223, 11.224, 11.227, 11.231, 11.233, 11.3, 12.12, 11.14, 11.17, 11.18; 36/100, 101, 115, 132, 15

(56) References Cited

U.S. PATENT DOCUMENTS 4,150,499 A * 4/1979 Wang ..... 36/115
5,340,132 A * 8/1994 Malewicz ..... 280/11.22
5,595,392 A * 1/1997 Casillas ..... 280/7.13
5,855,380 A * 1/1999 Filippo et al. ..... 280/7.13
6,000,704 A * 12/1999 Balbinot et al. ..... 280/11.3
6,113,123 A * 9/2000 Cabanis et al. ..... 280/341
6,120,038 A * 9/2000 Dong et al. ..... 280/7.13
6,135,463 A * 10/2000 Wrike ..... 280/11.22
6,145,854 A * 11/2000 Cheng ..... 280/11.22
6,164,669 A * 12/2000 Svensson ..... 280/11.3
6,217,035 B1 * 4/2001 Steinhauser, Jr. ..... 280/7.14
6,308,964 B1 * 10/2001 Chang ..... 280/7.13 X
6,328,318 B1 * 12/2001 Hsu ..... 280/11.223

* cited by examiner

*Primary Examiner*—Brian L. Johnson
*Assistant Examiner*—Brian Fishmann

(57) ABSTRACT

Skates attachable to sneakers. The device includes a sneaker body and a lower functional unit (such as an ice-skate unit, a roller skate unit, etc.), assembled with or disassembled from each other. The sneaker body has a sole and a large sole under the sole, and the sole has recesses and a tenon formed in each recess, and one of the tenons has an insert hole in its sidewall. The lower functional unit has plural connect members with mortises engaging the tenons. Each connect member has a stop plate in front of the mortise, with an aperture formed between them for a safety pin and a spring fitted around the pin to fit therein. The safety pin passes through the hole of the stop plate and a lateral hole of the inner wall of the mortise, with its outer end inserting in the insert hole of the tenon. A curved rod is combined with the safety rod, forcing the safety pin to move back and forth to permit the sneaker body assembled with or disassembled from the lower function unit to become ice-skates, roller skates, etc.

5 Claims, 6 Drawing Sheets

SKATE ATTACHABLE TO AN ATHLETIC SHOE

BACKGROUND OF THE INVENTION

1. Field of the Invention

This invention relates to a pair of skates changeable to a pair of common sneakers, particularly to one having a sneaker body and an ice skating unit combinable with or separable from the sneaker body to be used for two objects.

2. Description of the Prior Art

Sneakers have a wide variety for different designs and uses, such as for basketball, jogging, mountaineering, and special sports (such as ice-skating, roller-skating in-line skating, etc.). Special sports shoes have special and different functions for special sports, impossible to be widely used as common sneakers, limited in usable time and places.

SUMMARY OF THE INVENTION

The objective of the invention is to offer skates changeable to common sneakers for walking or jogging having an ice skating unit combinable with or separable from the sneaker body.

One feature of the invention is that the sneaker body includes recesses formed in a first sole and a second sole under the first sole, a tenon formed in each recess, an insert hole formed in one side of one tenon, and an ice skating unit combined with the first sole of the sneaker body and having plural connect members respectively having a mortise and fitting in the recesses of the first sole, with the each mortise engaging with the tenon in each recess of the first sole, and a safety pin and a coil spring fitting around the safety pin fitted in an aperture defined between a stop plate and an inner wall of each mortise and passing a center hole of the stop plate and a lateral hole in the inner wall of the mortise and in the insert hole of a side wall of the tenon. A curved rod is combined with an inner end of the safety pin, pressed or released to move the safety pin back and forth to assemble or disassemble the sneaker body with or from the lower functional unit to form an ice skate or a roller skate or an in-line skate.

BRIEF DESCRIPTION OF DRAWINGS

This invention will be better understood by referring to the accompanying drawings, wherein.

BRIEF DESCRIPTION OF THE PREFERRED EMBODIMENT

Figure 1:
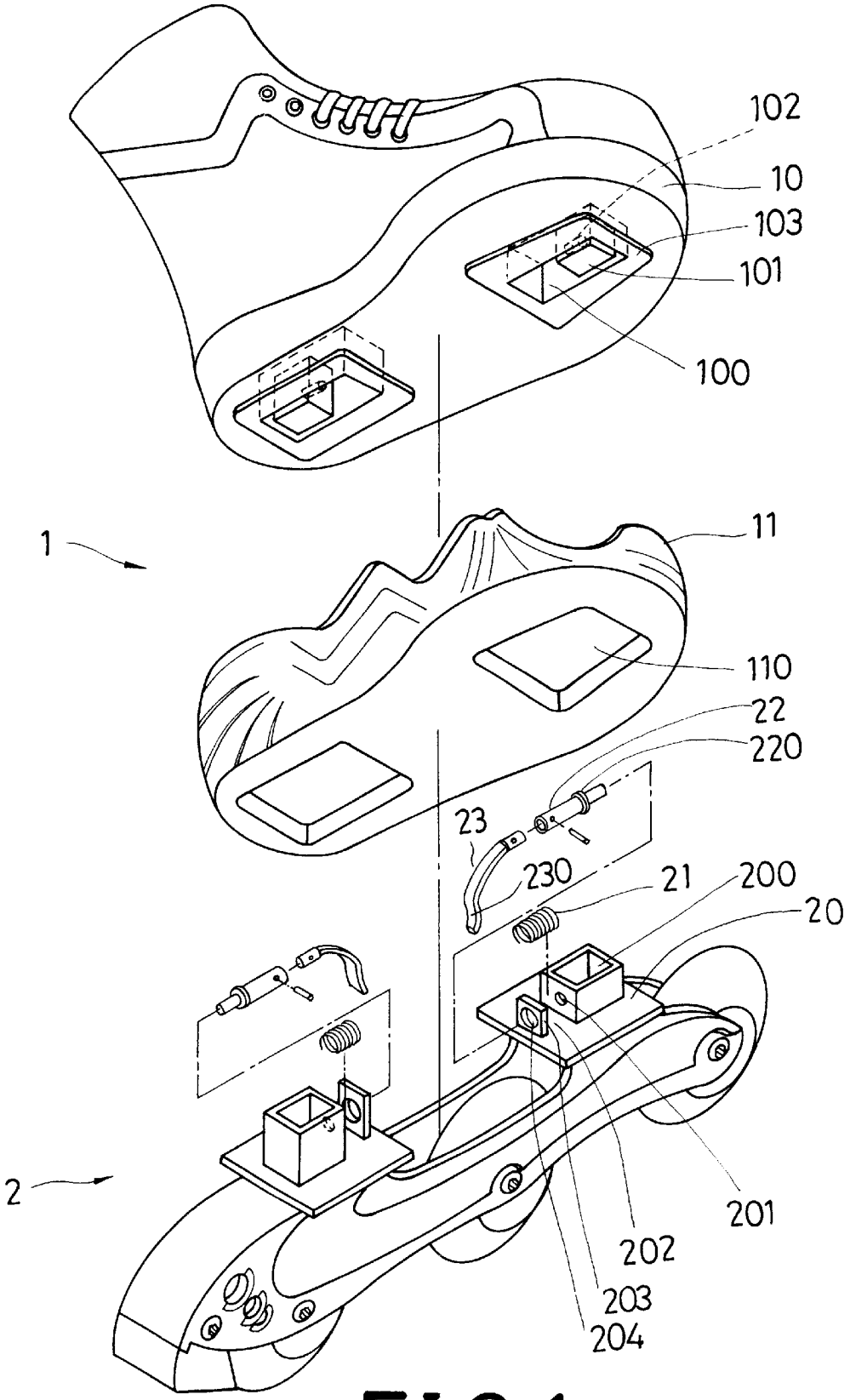
FIG. 1 is an exploded perspective view of an in-line skate attachable with an athletic shoe in the present invention.
Figure 2:
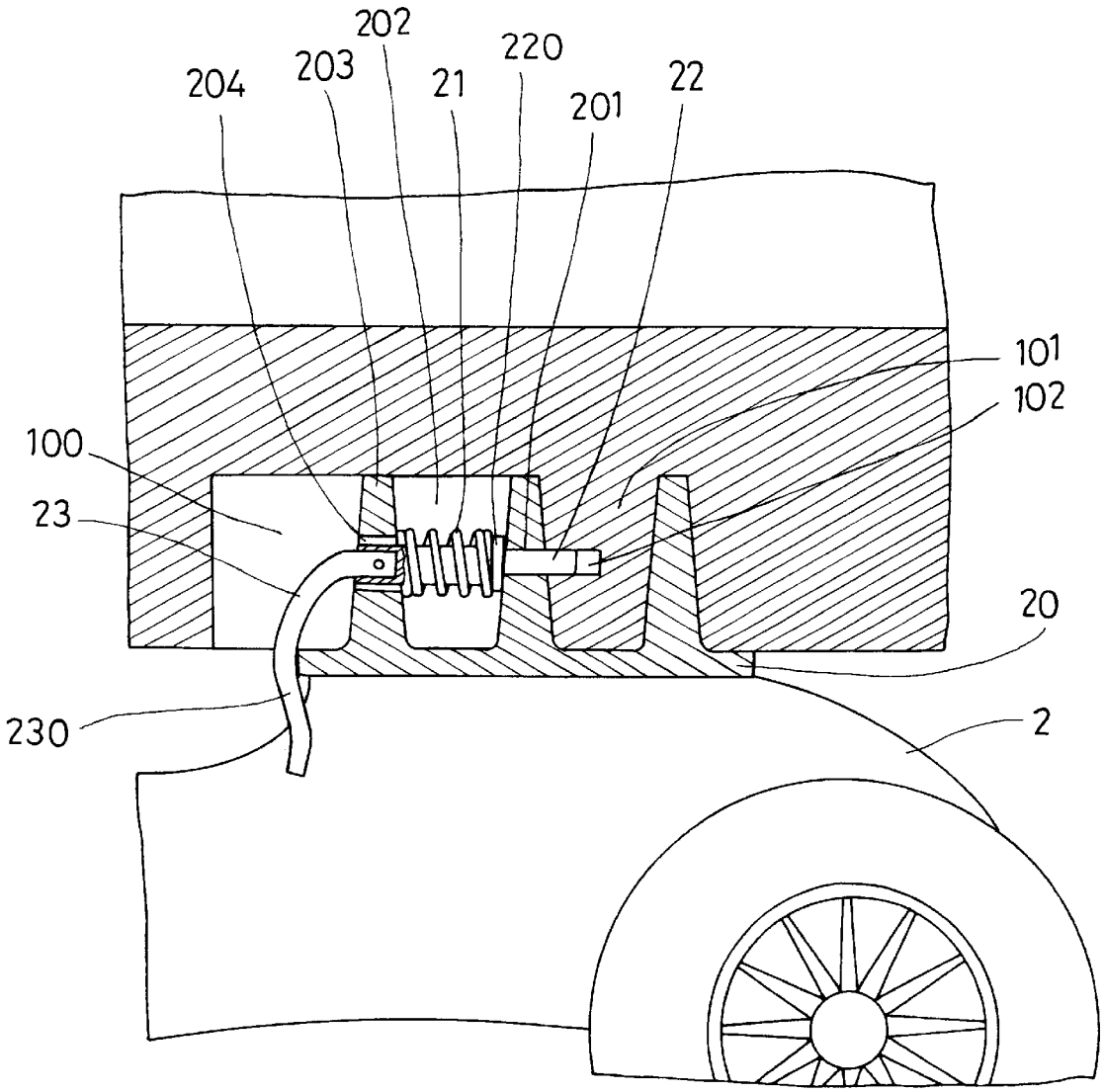
FIG. 2 is a partial cross-sectional view of the skates attachable with an athletic shoe in the present invention, showing a safety pin and its related components.

A preferred embodiment of skates changeable to common sneakers in the present invention, as shown In FIGS. 1 and 2, includes a sneaker body 1, and a lower functional unit 2 (an in-line skate unit illustrated in Figures, but, an ice skate unit or a roller-skate unit also possible to be used) combined together separably.

The sneaker body 1 includes a first sole 10 and a large separate sole or a second 11 under the first sole 10, and the first sole 10 has plural recesses 100 spaced apart properly. Each recess 100 has a tenon 101, and one of the tenons 101 has a sidewise insert hole 102 in a sidewall. Further, a circumferential projecting edge 103 is formed around each recess 100. The large separate sole 11 surrounds and adheres with the sole 10, having through holes 110 aligned to the recesses 100 and the circumferential projecting edges 103 just fit tightly in an inner wall of each through hole 110, as shown in FIG. 2.

The lower functional unit 2 may be assembled with or disassembled from the sneaker body 1. The lower functional unit 2 may have an exclusive function for in-line skating but can be adapted as an ice skate unit, or a roller skate unit. The lower functional unit 2 has plural connect members 20 formed on a rear portion thereof and on a front portion of an upper surface and is provided with mortises 200 to engage with the tenon 101 of each recess 100.

The sneaker body 1 includes the sole 10 (first sole) and the large separate sole 11 (second sole) which is fastened under the sole 10. The sneaker body 1 is detachably combined with the lower functional unit 2 (the in-line skating unit, the ice skate unit or the roller skate unit).

Figure 3:
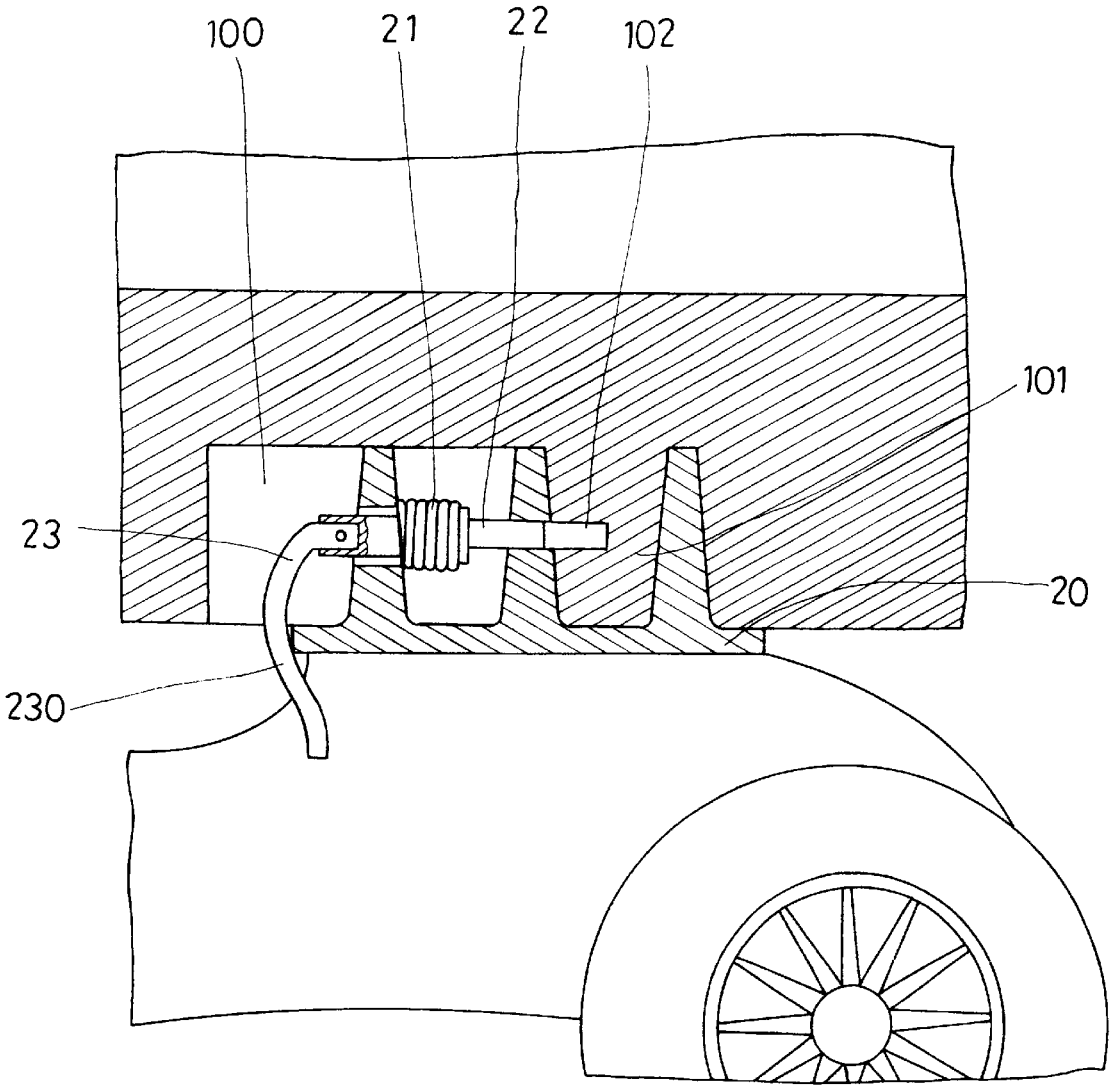
FIG. 3 is a cross-sectional view of the safety pin pulled to function in the present invention.

Further the mortise 200 of each connect member 20 has a lateral hole 201 in an inner wall defining each mortise 200, and a stop plate 203 vertically provided in front of each mortise 200 on each connect member 20 and having a center hole 204 in line to the lateral hole 201. An aperture 202 is formed between the inner wall of each mortise 200 and each stop plate 203 for receiving a safety pin 22 and a coil spring 21 fitting around the safety pin 22 therein. Further, the safety pin 22 passes through the center hole 204 of the stop plate 203, the coil spring 21 and the lateral hole 201 of the mortise 200, with its front end inserted in the sidewise insert hole 102 of the tenon 102 of the first sole 10, and an intermediate portion of the safety pin is fitted with a stop ring 220 that is adapted to rest against the outer wall of the lateral hole 201 of the mortise 200. Further, a curved rod 23 is provided to have its rear end connected firmly to the inner end of the safety pin 22, an intermediate point resting against an inner end side of the connect member 20, and a free end 230 forming a slight curve outwards. Thus each curved rod 23 can be pulled back and forth for each safety pin 22 by with the intermediate point as used a fulcrum, and the coil spring 21 can force the safety pin 22 to move automatically back to its original position with its resilience, as shown in FIGS. 2 and 3.

Figure 4:
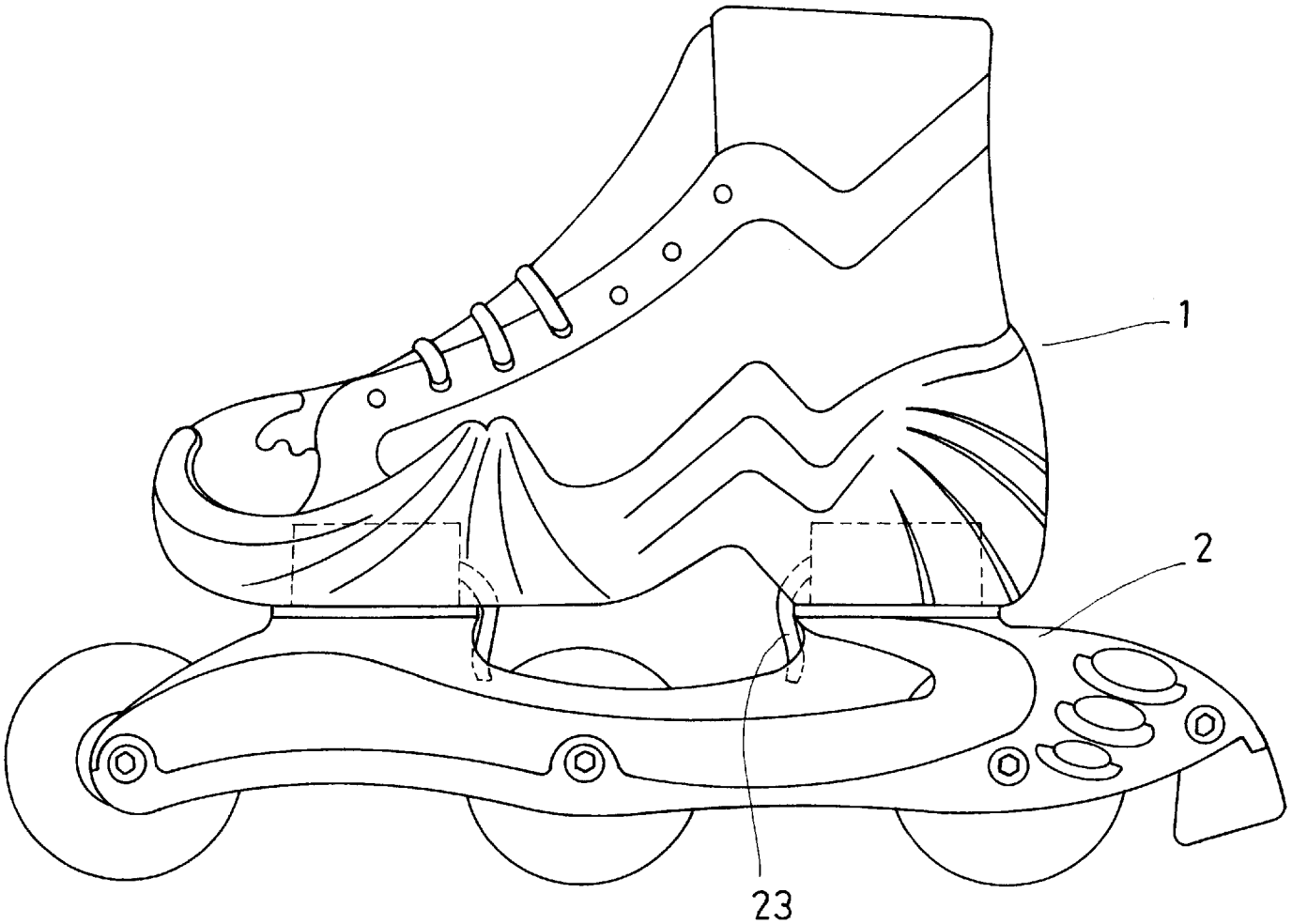
FIG. 4 is a side view of the ice-skaters changeable to common sneakers in the present invention.

During assembly and use, referring to FIGS. 1, 2, 3 and 4, the large sole or the second sole 11 is positioned to surround the first sole 10 and the soles are adhered together, with the through holes 111 respectively aligned to the relative recesses 100 and the circumferential edges 103, completing assembly of the sneaker body 1. Next, the assembled sneaker body 1 is assembled with the lower functional unit 2, the tenons 101 are aligned and inserted in the mortises 200 of the connect members 20 of the lower functional unit 2, and the end 230 of the curved rod 23 is pressed to force the stop ring 220 of the safety pin 22 to compress the coil spring 21 which in turn forces the front end of the safety pin 22 to insert in the insert hole 102 of the tenon 101 and become stabilized therein, as shown in FIG. 2. Then the sneaker body 1 is stably assembled with the lower roller-skating unit 2, and the unit is usable as in-line skates as shown in FIG. 4.

Figure 5:
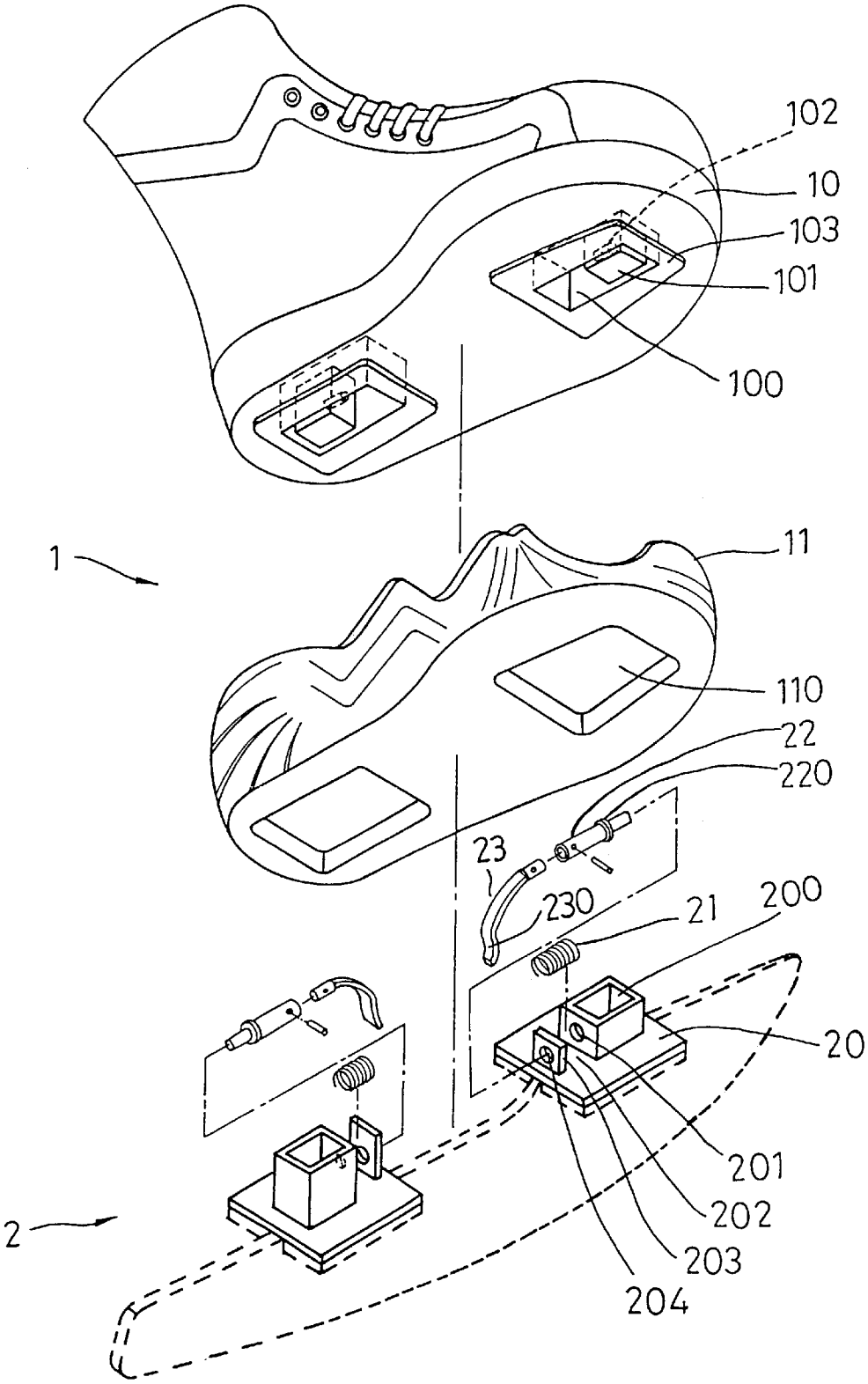
FIG. 5 is an exploded perspective view of an ice-skate attachable with an athletic shoe in the present invention.
Figure 6:
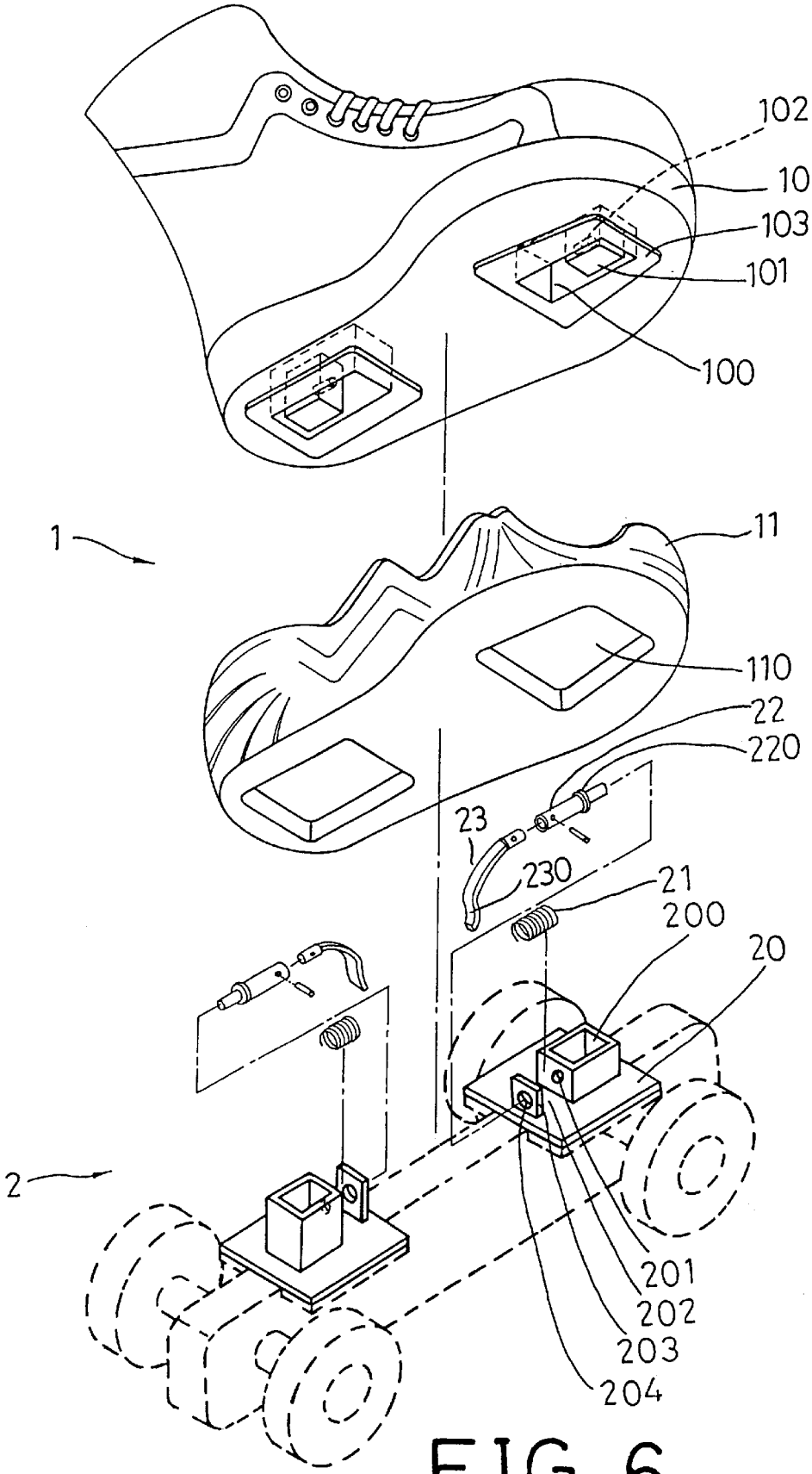
FIG. 6 is an exploded perspective view of a roller skate attachable to an athletic shoe in the present invention.

FIGS. 5 and 6 illustrate the use of the inventive device with ice-skates and roller skates.

The invention has the following advantages, as understood from the aforesaid description.

1. The inventive device has a few components, and can be quickly and conveniently assembles and disassembled.
2. The inventive device can be used as common leisure sneakers.
3. The inventive device is cost effective and utilizes minimal storing space.

While the preferred embodiment of the invention has been described above, it will be recognized and understood that various modifications may be made therein and the appended claims are intended to cover all such modifications that may fall within the spirit and scope of the invention.

What is claimed is:

1. A sneaker body in combination with a lower functional unit, wherein;

the lower functional unit is selected from the group consisting of an ice skate unit, a roller skate unit and an in-line skate unit;

the sneaker body and the lower functional unit are assembled together;

the sneaker body comprising a first sole and a second sole that are combined together with the second sole partially covering the first sole, the first sole provided with plural recesses that are spaced apart, each of the recesses having a tenon extending therein from the first sole, one of the tenons having an insert hole in one side wall of the respective one of the recesses;

the lower functional unit comprising plural connect members on an upper surface thereof and adapted to correspond with respective ones of the recesses of the first sole, each of the connect members having a mortise adapted to engage with a respective one of the tenons, the connect members each having a stop plate and an aperture defined by the stop plate and an inner wall of each of the mortises, a safety pin and a coil spring fitting around the safety pin positioned in the aperture, the safety pin passing through the coil spring and a center hole of the stop plate, a lateral hole of the mortise and the insert hole of the tenon; and a curved rod connected firmly with an outer end of the safety pin to move the safety pin back and forth, so that the sneaker body is assembled with the functional unit.

2. The sneaker body in combination with a lower functional unit as claimed in claim 1, wherein the first sole has a projecting circumferential edge around each of the recesses, the second sole has through holes corresponding to the recesses of the first sole, and the circumferential edges fit around respective ones of the recesses of the first sole and rests against an inner wall of the recesses of the first sole.

3. The sneaker body in combination with a lower functional unit as claimed in claim 1, wherein the stop plate on the lower functional unit has a center hole aligned to the lateral hole of each of the mortises.

4. The sneaker body in combination with a lower functional unit as claimed in claim 1, wherein the safety pin of the lower functional unit passes through the center hole of the stop plate, the coil spring, and the lateral hole of the mortise, with its end inserted in the insert hole of the tenon of the hole, and the safety pin has an intermediate portion fitted with a stop ring that rests against an outer wall of the lateral hole.

5. The sneaker body in combination with a lower functional unit as claimed in claim 4, wherein the curved rod is connected with the safety pin, the curved rod has an outer end that is curved downwards and protruding out of the lower functional unit, and when the curved rod is pressed, the safety pin engages or releases the sneaker body from the functional unit.

* * * * *